US007850297B2

(12) United States Patent
Jung

(10) Patent No.: US 7,850,297 B2
(45) Date of Patent: Dec. 14, 2010

(54) IMAGE FORMING APPARATUS

(75) Inventor: Youn-gun Jung, Yoning-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 593 days.

(21) Appl. No.: 11/852,398

(22) Filed: Sep. 10, 2007

(65) Prior Publication Data

US 2008/0149202 A1 Jun. 26, 2008

(30) Foreign Application Priority Data

Dec. 21, 2006 (KR) ..... 10-2006-0131754

(51) Int. Cl.
*B41J 2/185* (2006.01)
*B41J 2/175* (2006.01)

(52) U.S. Cl. ..... 347/90; 347/84

(58) Field of Classification Search ..... 347/29, 347/30, 36, 84, 90, 92, 97; 137/15.22, 625.12, 137/630.15, 630.17, 902, 614.2
See application file for complete search history.

(56) References Cited

U.S. PATENT DOCUMENTS 5,864,352 A * 1/1999 Aoki et al. ..... 347/102
7,357,479 B2 * 4/2008 Brugue et al. ..... 347/30
2006/0055730 A1 3/2006 Ono et al.

FOREIGN PATENT DOCUMENTS

| | | |
|---|---|---|
| EP | 1652675 | 5/2006 |
| JP | 59-85766 | 5/1984 |
| JP | 60-184851 | 9/1985 |
| JP | 1-209147 | 8/1989 |
| KR | 2005-112446 | 11/2005 |

OTHER PUBLICATIONS

European Search Report dated Feb. 26, 2008 issued in EP 07117351.2.

* cited by examiner

*Primary Examiner*—Anh T. N. Vo
(74) *Attorney, Agent, or Firm*—Stanzione & Kim LLP

(57) ABSTRACT

An image forming apparatus includes a cartridge which ejects an ink, a chamber having an inlet unit which inhales a fog generated when the ink is ejected from the cartridge and an outlet unit which exhales the inhaled fog, an air pressure generating unit which is connected to the chamber to generate an air pressure to inhale and exhale the fog from the chamber, and a valve unit which selectively opens and closes the inlet unit and the outlet unit by the air pressure which is generated in the air pressure generating unit.

18 Claims, 8 Drawing Sheets

IMAGE FORMING APPARATUS

CROSS-REFERENCE TO RELATED APPLICATIONS

This application claims priority under 35 U.S.C. §119(a) from Korean Patent Application No. 2006-0131754, filed on Dec. 21, 2006 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having a configuration to remove a fog generated when ink is ejected from a cartridge.

2. Description of the Related Art

An image forming apparatus of an ink-jet type forms an image by ejecting ink from a cartridge onto a recording material.

The image forming apparatus provides a nozzle unit to eject the ink on a bottom surface of the cartridge. Accordingly, as the ink is repetitively ejected, the nozzle unit clogs with bubbles, foreign substances, or the like so that the ink cannot be smoothly ejected. Accordingly, a spitting process for ejecting a predetermined amount of ink through the nozzle unit is performed to prevent a channel of the nozzle unit from clogging, as one example of a maintenance process performed during a period in which the image forming apparatus is not forming an image.

A conventional image forming apparatus has a spitting unit below the nozzle unit, which collects the ejected ink from the nozzle unit during the spitting process. However, during the spitting process, a lot of fine ink fogs above the spitting unit.

Since the conventional image forming apparatus does not collect the fog, many malfunctions may be caused by the fog generated at the spitting process and attached to the nozzle unit, the cartridge, and the like. The fog pollutes an inner part of the image forming apparatus and lowers an image quality of the image formed on the recording materials.

Thus, it may be desired to collect and remove the fog generated at the spitting process.

SUMMARY OF THE INVENTION

The present general inventive concept provides an image forming apparatus to collect and remove an ink fog.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing an image forming apparatus comprising a cartridge which ejects an ink, a chamber having an inlet unit which inhales a fog which is generated when the ink is ejected from the cartridge and an outlet unit which exhales the inhaled fog, an air pressure generating connected to the chamber to generate an air pressure to inhale and exhale the fog from the chamber, and a valve unit which selectively opens and closes the inlet unit and the outlet unit by the air pressure generated in the air pressure generating unit.

The air pressure generating unit may comprise a bellows unit which expands and compresses to change the inner pressure of the chamber, and a driving unit to expand and compress the bellows unit.

The air pressure generating unit may comprise a cylinder to communicate with the chamber, a piston to reciprocate in the cylinder to expand and compress the inner air of the cylinder, and a driving unit to reciprocate the piston.

The image forming apparatus may further comprise a fog receiving unit connected to the outlet unit to receive the fog which is exhaled from the chamber.

The chamber may comprise a first room formed with the inlet unit on a first side thereof to communicate with the air pressure generating unit on a second side thereof, a second room separated from the first room and formed with the outlet unit on one side thereof, and a chamber communicating unit to be formed so as to allow the first room to communicate with the second room.

The valve unit may comprise an inlet opening/closing member to open and close the inlet unit according to the pressure change of the first room, and an outlet opening/closing member to open and close the chamber communicating unit according to the pressure change of the first room.

The valve unit may comprise an inlet valve unit provided in the inlet unit and opened if the fog is inhaled to the chamber, and an outlet valve unit provided in the outlet unit and opened if the fog is exhaled from the chamber.

The valve unit may have a plate shape to be mounted to the chamber, and the inlet valve unit and the outlet valve unit may be formed on a plate surface of the valve unit.

The foregoing and/or other aspects and utilities of the present general inventive concept are also achieved by providing an image forming apparatus, comprising a cartridge to eject ink, a spitting unit to receive the ink ejected from the cartridge during a spitting process, and a fog removing unit to remove a fog generated during the spitting process, the fog removing unit comprising a chamber connected to the spitting unit to inhale the fog therefrom, a fog receiving unit to receive a fog exhaled from the chamber, and an air pressure generating unit to change an internal air pressure of the chamber to inhale the fog from the spitting unit and exhale the fog to the fog receiving unit.

The chamber may comprise an inlet unit to receive the fog from the spitting unit, an outlet unit to direct the fog to the fog receiving unit, and a valve unit to selectively open and close the inlet unit and the outlet unit by the air pressure changes generated by the air pressure generating unit.

The valve unit may comprise a flexible plate to allow one-way flow of the fog through only one of the inlet and outlet units according to the internal air pressure of the chamber.

The inlet unit may comprise a gravity valve to allow the fog into the chamber when the internal pressure thereof is decreased by the air pressure generating unit, and prevents the fog from flowing back to the spitting unit when the internal pressure of the chamber is increased by the air pressure generating unit.

The outlet unit may comprise a gravity valve to allow the fog in the chamber to flow to the fog receiving unit when the internal pressure of the chamber is increased by the air pressure generating unit, and prevents the fog from flowing back from the fog receiving unit when the internal pressure of the chamber is decreased by the air pressure generating unit.

The foregoing and/or other aspects and utilities of the present general inventive concept are also achieved by providing a fog absorption apparatus to absorb fog created from an ink spitting unit, the apparatus comprising a fog chamber including a first one way valve to inhale fog from an ink spitting process of the ink spitting unit and a second one way valve to exhale the inhaled for externally away from the ink spitting unit.

The fog absorption apparatus may further comprise an air pressure generation unit to generate a negative air pressure in the fog chamber so that the fog chamber inhales the fog and to generate a positive air pressure so that the fog chamber exhales the inhaled fog.

The first one way valve may comprise an inlet pipe and a ball combination.

The second one way valve may comprise a first chamber room and a second chamber room and a chamber communicating unit.

The chamber communicating unit may comprise a passage between the first and second chamber rooms and a ball disposed at the passage to block airflow in one direction.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings of which.

DETAILED DESCRIPTION OF THE PREFERRED EMBODIMENTS

Figure 1:
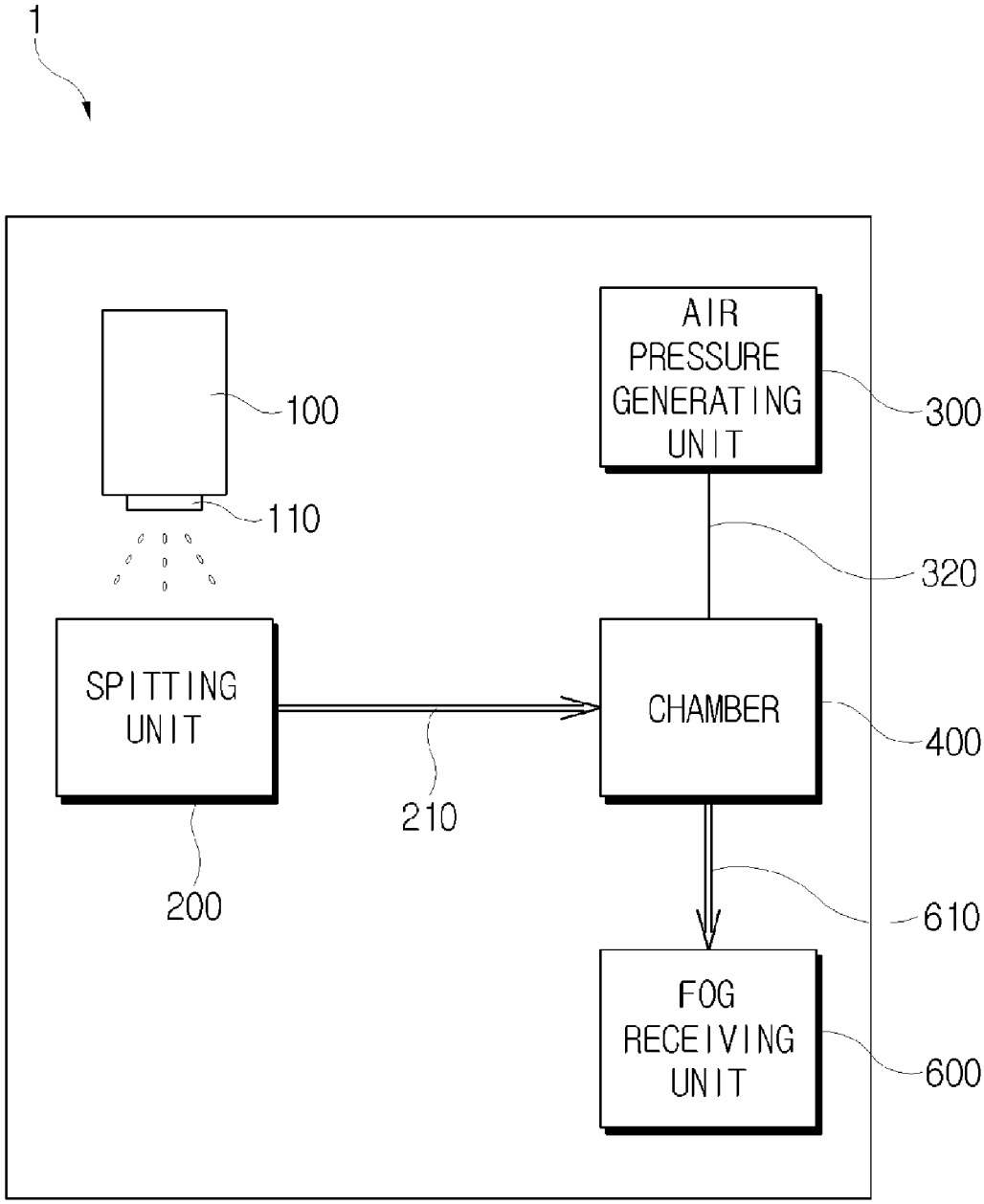
FIG. 1 illustrates a configuration of an image forming apparatus according to an exemplary embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

As illustrated in FIG. 1 to FIG. 3B, an image forming apparatus 1 according to an exemplary embodiment of the present general inventive concept may include a cartridge 100 to eject ink, a spitting unit 200 to provide a spitting region below the cartridge 100, an air pressure generating unit 300 to generate air pressure to inhale and exhale a fog generated by the spitting unit 200, a chamber 400 to inhale the fog and exhale the inhaled fog by the generated air pressure, a valve unit 500 to selectively open/close an inlet path and an outlet path of the fog, which is provided in the chamber 400, and an exhaled-fog receiving unit 600 to exhale the fog inhaled to the chamber 400.

The cartridge 100 stores ink therein and ejects the ink onto recording materials through a nozzle unit 110 provided on a bottom surface of the cartridge 100 so that an image of an image data can be formed. The cartridge 100 can be applicable to various known inkjet cartridge technologies, such as an array type cartridge, a shuttle type cartridge, or the like. In the case of the array type, the cartridge 100 can be fastened in the image forming apparatus 1 and the nozzle unit 110 can have a length to correspond to a width of the recording materials.

The nozzle unit 110 can be provided on the bottom surface of the cartridge 100 and can communicate with an inner part of the cartridge 100 so that the ink can be ejected from the nozzle unit 110. As the nozzle unit 110 repetitively ejects the ink, a channel (not illustrated) which communicates with the inner part of the cartridge 100 may clog by various foreign substances so that the ink may not be smoothly ejected. A spitting process can be performed to solve this problem. For example, in the nozzle unit 110, a positive pressure can be formed by a pressure adjusting apparatus (not illustrated) connected to the cartridge 100 so that the channel can be cleaned while a predetermined amount of ink is ejected.

The spitting unit 200 is provided below the cartridge 100 while facing the nozzle unit 110. In the case of the array type cartridge 100, the spitting unit 200 is lengthened along a lengthwise direction of the cartridge 100 to correspond to the nozzle unit 110. The spitting unit 200 can be disposed in a position where it does not interfere with moving of the recording materials while an image is formed on the recording materials during a standby mode, and can move below the nozzle unit 110 by a predetermined driving apparatus (not illustrated) during the spitting process.

The spitting unit 200 may include a separate receiving unit (not illustrated) to receive the ink ejected from the nozzle unit 110 at the spitting process. At this time, the ink which is ejected and scattered from the spitting unit 200 forms a fog around the spitting unit 200. The fog is inhaled into an inlet pipe 210 provided on one side of the spitting unit 200 or adjacent to the spitting unit 200, and is directed to the chamber 400.

One side of the air pressure generating unit 300 communicates with the chamber 400. The air pressure generating unit 300 generates an air pressure so that the fog can be inhaled by the inlet pipe 210 and directed to the chamber 400. Also, the air pressure generating unit 300 generates another air pressure so that the fog directed to the chamber 400 can be exhaled to the fog receiving unit 600.

The air pressure generating unit 300 can communicate with one side of the chamber 400 so that the inner pressure of the chamber 400 can increase or decrease so as to have a predetermined pressure difference in comparison with an atmospheric air pressure. If the air pressure generating unit 300 makes the inner pressure of the chamber 400 decrease, the fog can be inhaled to the chamber 400. On the other hand, if the air pressure generating unit 300 makes the inner pressure of the chamber 400 increase, the fog inhaled to the chamber 400 is exhaled. The air pressure generating unit 300 repeats the above process so that the fog can be repetitively inhaled to the chamber 400 and exhaled to the fog receiving unit 600. The inner pressure difference of the chamber 400 generated by the air pressure generating unit 300 may be changed by a person skilled in the art in consideration of a plurality of design conditions.

The air pressure generating unit 300 may include a bellows unit 310 to be alternately expanded and compressed, a chamber connecting pipe 320 to connect the bellows unit 310 and the chamber 400, and a driving unit 330 to repetitively expand and compress the bellows unit 310.

The bellows unit 310 can be a plurality of creases which are repetitively formed along a lengthwise direction. A first side of the bellows unit 310 is supported by a bellows supporting unit 311, and the creases of a second side of the bellows unit 310 are repetitively expanded and compressed by a driving unit 330.

The bellows unit 310 can have airtight to prevent external air from being introduced thereinto. If the bellows unit 310 is expanded, the inner pressure of the chamber 400 decreases through the chamber connecting pipe 320 which passes through the bellows supporting unit 311 and is connected to the inner part of the bellows unit 310. On the other hand, if the bellows unit 310 is compressed, the inner pressure of the chamber 400 increases.

The driving unit 330 may include a driving source 331 to generate a power, and a power transmission unit 333 to transmit the power from the driving source 331 to the bellows unit 310 so as to repeatedly expand and compress the bellows unit 310.

Figure 2:
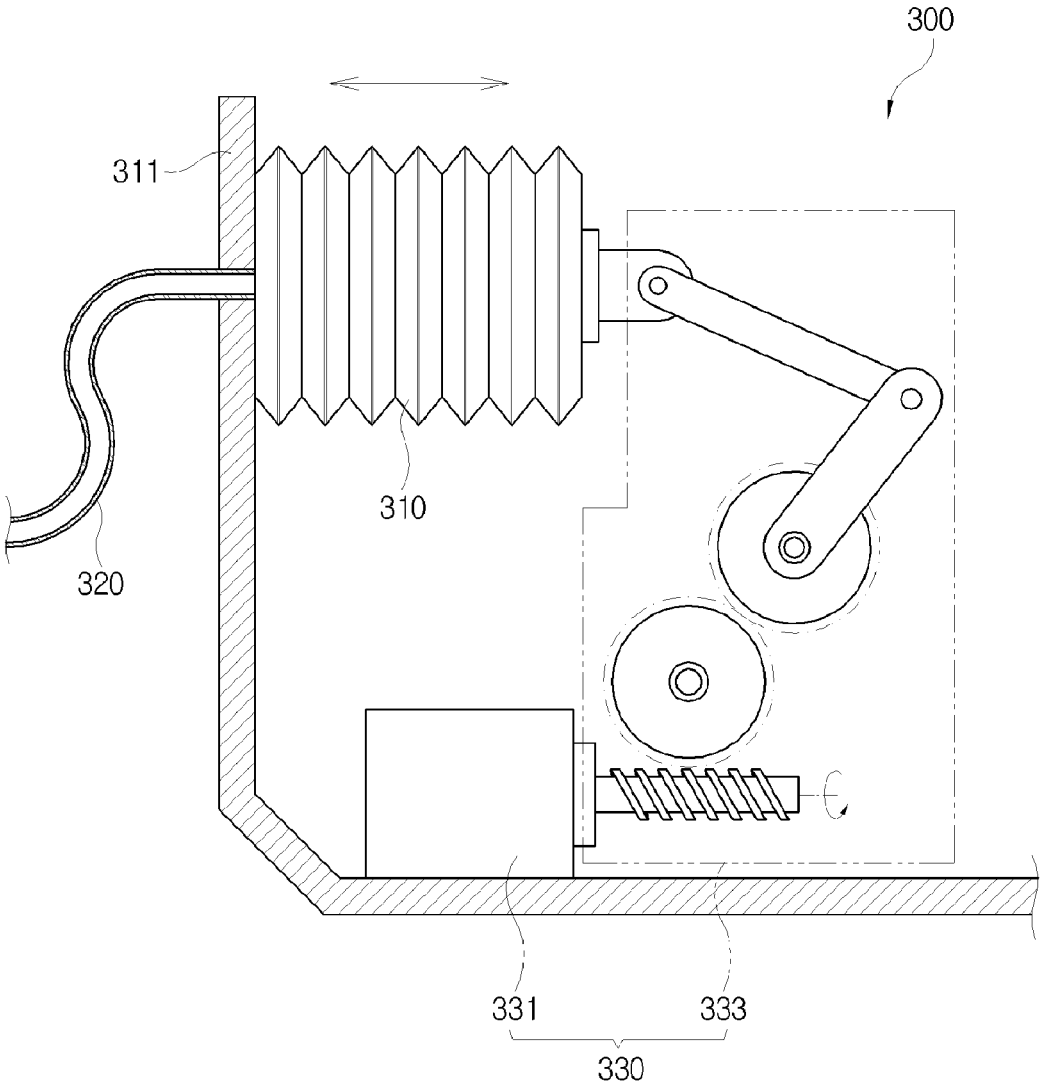
FIG. 2 is a lateral view of an air pressure generating apparatus according to an exemplary embodiment of the present general inventive concept.
Figure 3A:
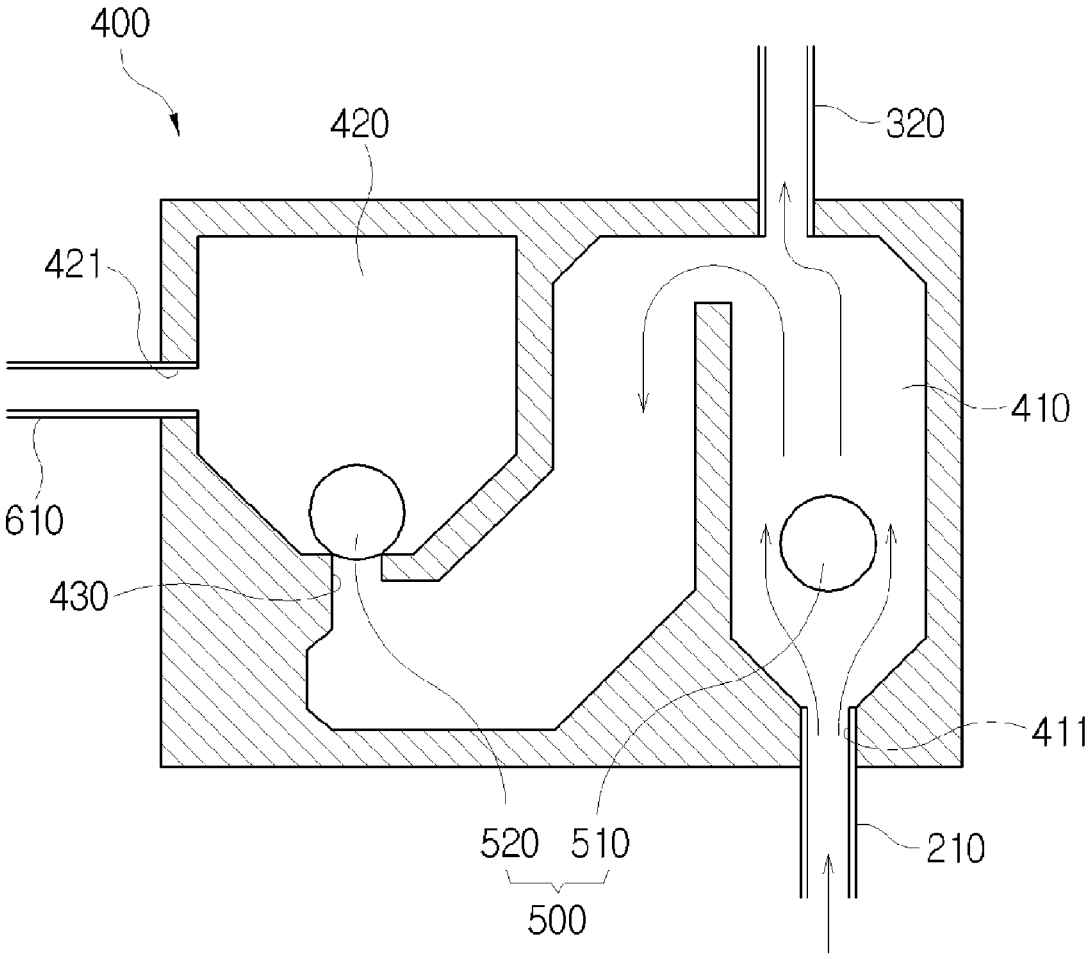
FIGS. 3A and 3B are lateral-sectional views illustrating an operation in a chamber according to an exemplary embodiment of the present general inventive concept.
Figure 3B:
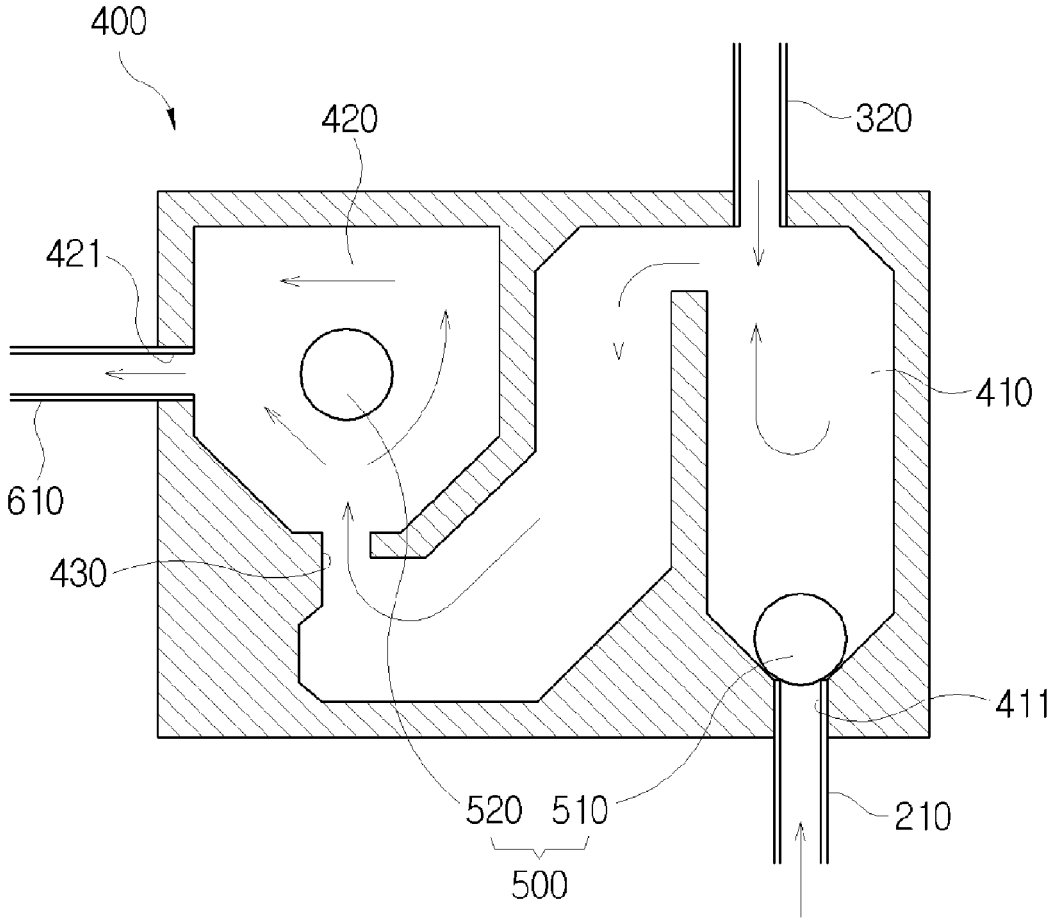
Figure 4:
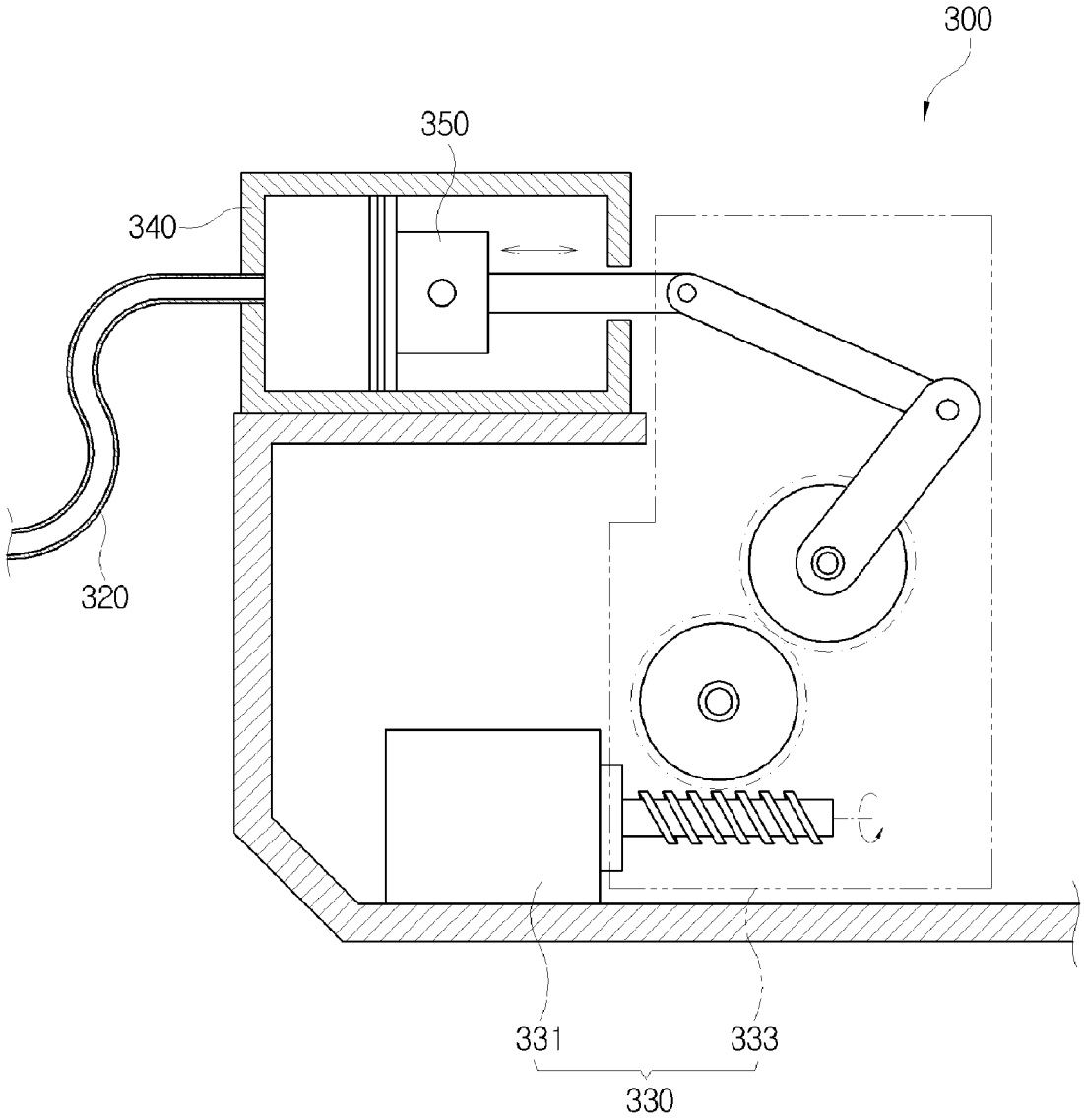
FIG. 4 is a lateral view of an air pressure generating apparatus according to another exemplary embodiment of the present general inventive concept.
Figure 5A:
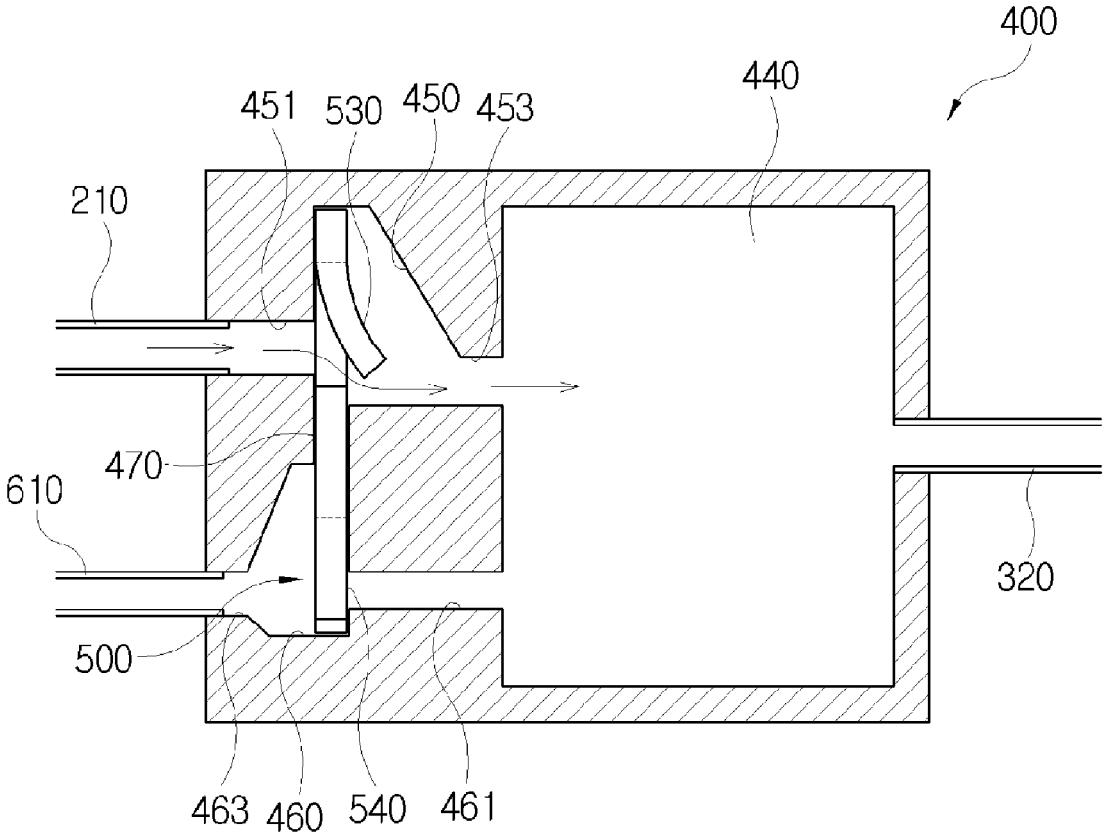
FIGS. 5A and 5B are lateral-sectional views illustrating an operation in a chamber according to another exemplary embodiment of the present general inventive concept.
Figure 5B:
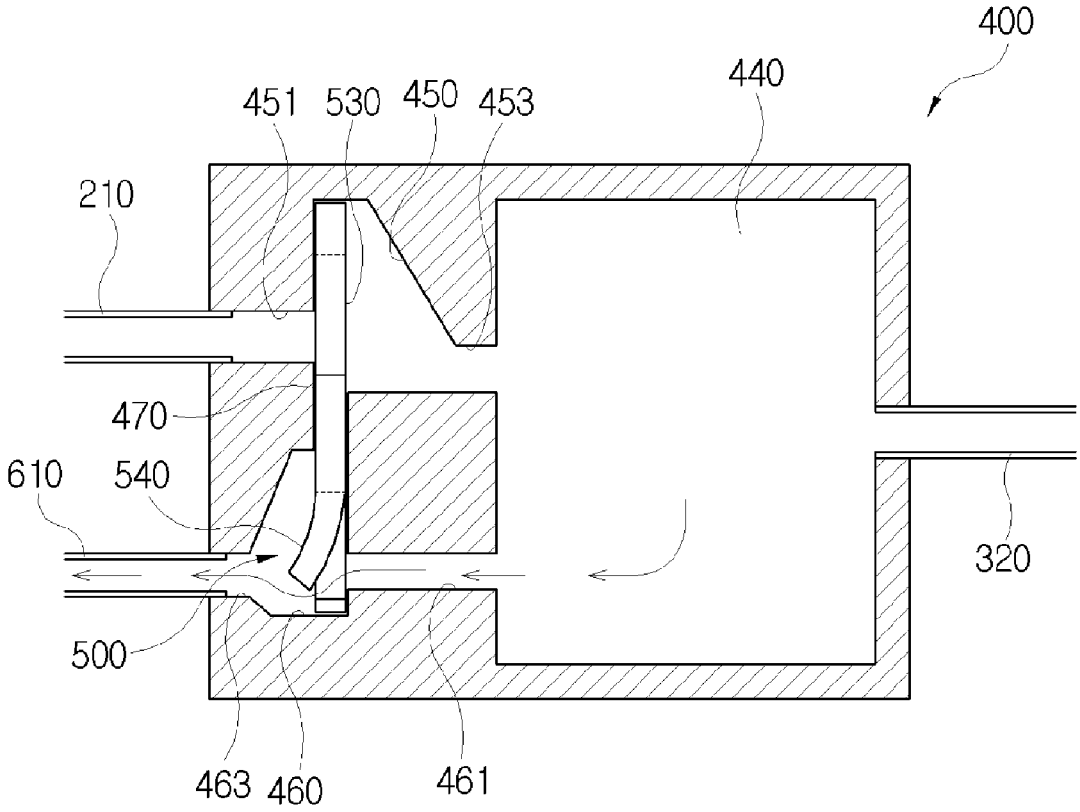
Figure 6:
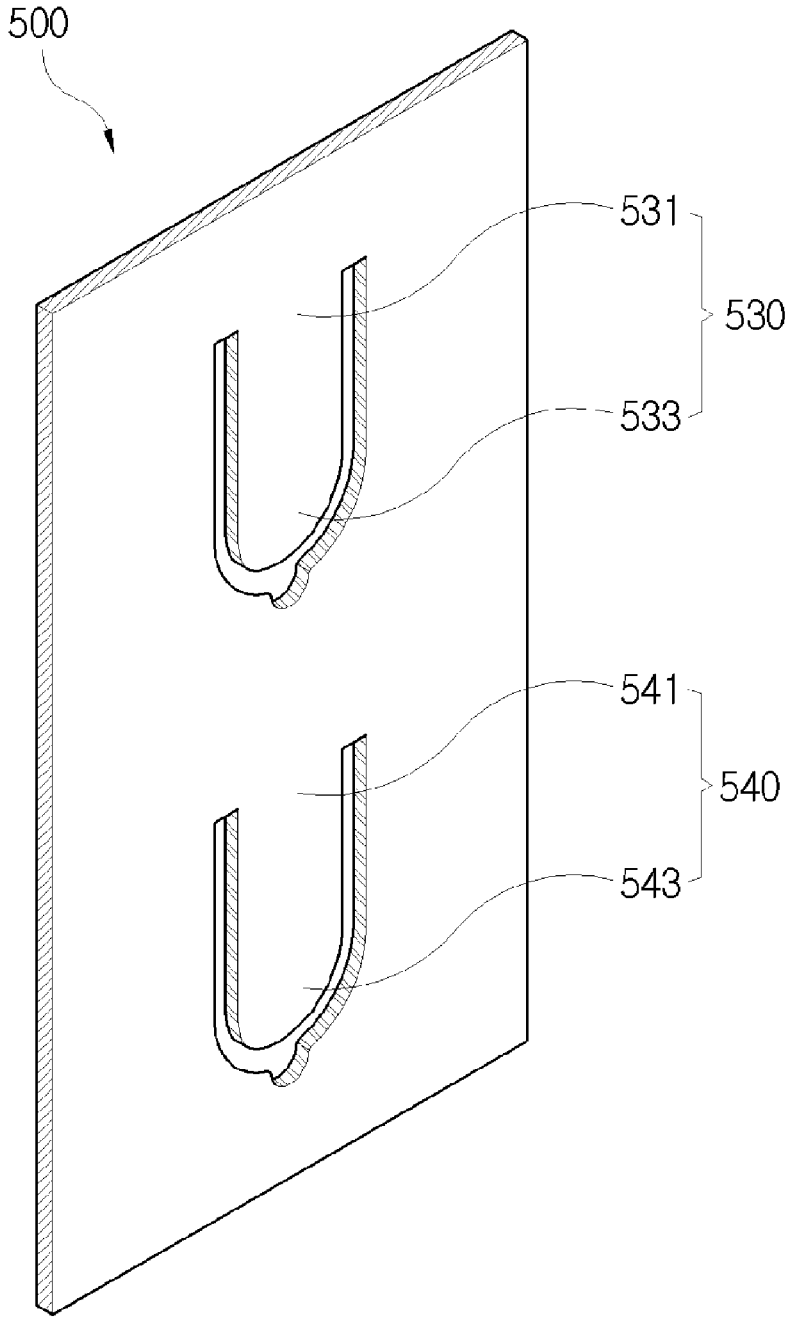
FIG. 6 is a perspective view of a valve unit illustrated in FIGS. 5A and 5B.

The power transmission unit 333 can employ a gear, a connecting-rod, etc. which are interlocked for the power transmission and can transform a rotatory motion of the driving source 331 to a linear motion of the bellows unit 310. In the exemplary embodiment of the present general inventive concept as illustrated in FIG. 2, the air pressure generating unit 300 itself has the driving unit 331. However, the power transmission unit 333 can transfer the power from other driving apparatuses (not illustrated) of the image forming apparatus 1 without the driving source 331.

The chamber 400 has a space therein, which is airtight from the outside. The chamber 400 is connected to the air pressure generating unit 300 so that the inner pressure of the chamber 400 can be changed by the air pressure generated in the air pressure generating unit 300. By this, the fog is directed to the inner part of the chamber 400 through the inlet pipe 210, or the fog directed to the chamber 400 is exhaled to the fog receiving unit 600.

The inner part of the chamber 400 can be partitioned into a first room 410 and a second room 420. The first room 410 and the second room 420 may communicate by a chamber communicating unit 430.

On a first side of the first room 410 is provided an inlet unit 411 connected to the inlet pipe 210, and a second side of the first room 410 is connected to a chamber connecting pipe 320. Installation positions of the inlet unit 411 and the chamber connecting pipe 320 are not limited. However, the inlet unit 411 and the chamber connecting pipe 320 can be formed in a bottom surface of the first room 410 so that an inlet opening/closing member 510 (to be described later) can easily close the inlet unit 411 by gravity. Also, the chamber connecting pipe 320 can be connected to an upper side of the first room 410 so that the amount of the fog directed to the chamber connecting pipe 320 can be minimized when the fog is inhaled to the inner part of the chamber 400.

While an inner configuration of the first room 410 is not limited by the present general inventive concept, a protrusion, an inclined plane, etc. which can guide the moving of the inlet opening/closing member 510 can be provided so that the inlet opening/closing member 510 (to be described later) can repetitively open/close the inlet unit 411 according to the pressure change of the first room 410. However, within the scope to achieve the above purpose, it is possible that the inner configuration of the first room 410 may vary in design. The configuration which allows the chamber communicating unit 430 and the inlet opening/closing member 510 to be separated from each other should be formed so that the inlet opening/closing member 510 (to be described later) can not be used to open/close the chamber communicating unit 430.

One side of the first room 410 communicates with the bellows unit 310 by the chamber connecting pipe 320. The pressure of the first room 410 decreases if the bellows unit 310 is expanded. On the other hand, the pressure of the first room 410 increases if the bellows unit 310 is compressed.

On the one side of the second room 420 is formed an outlet unit 421 connected to an outlet pipe 610 (to be described later). The second room 420 is air tightly isolated from the first room 410, and communicates with the first room 410 by the chamber connecting unit 430. While the inner configuration of the second room 420 is not limited by the present general inventive concept, an outlet opening/closing member 520 (to be described later) does not close the outlet unit 421 so that the fog can be exhaled without difficulty.

According to the pressure change of the first room 410, the chamber connecting unit 430 can be formed on the bottom surface of the second room 420 so that the outlet opening/closing member 520 can easily close the chamber connecting unit 430 by the gravity.

According to the pressure change of the first room 410, the valve unit 500 selectively opens and closes the inlet unit 411 and the chamber connection unit 430. The valve unit 500 includes the inlet opening/closing member 510 to open and close the inlet unit 411, and the outlet opening/closing member 520 to open and close the chamber connecting unit 430. The inlet opening/closing member 510 and the outlet opening/closing member 520 can be shaped like a ball having a larger diameter than those of the inlet unit 411 and the chamber communicating unit 430, respectively, so as to close the inlet unit 411 and the chamber communicating unit 430 without regard to their falling direction when they fall down after they float by the pressure change of the first room 410.

The inlet opening/closing member 510 placed in first room 410 opens/closes the inlet unit 411. If the bellows unit 310 is expanded and the pressure of the first room 410 decreases, the inlet opening/closing member 510 floats at a predetermined height so that the fog inhaled to the inlet unit 411 can be directed to the first room 410. At this time, the fog pushes up the inlet opening/closing member 510 from the inlet unit 411, which helps the inlet opening/closing member 510 float. With this, a weight of the inlet opening/closing member 510 may be overcome by the change of the pressure of the first room 410.

If the bellows unit 310 is compressed and the pressure of the first room 410 increases, the inlet opening/closing member 510 is downwardly pressurized toward the inlet unit 411 by the pressure and self-weight so as to close the inlet unit 411.

The outlet opening/closing member 520 in the inner part of the second room 420 opens and closes the chamber communicating unit 430. If the pressure of the first room 410 decreases by the bellows unit 310, the pressure of the second room 420 increases relatively higher than the first room 410. Accordingly, the outlet opening/closing member 520 closes the chamber communicating unit 430 by the pressure and the weight of the second room 420. On the other hand, if the pressure of the first room 410 increases by the bellows unit 310, the pressure of the second room 420 decreases relatively lower than the pressure of the first room 410. The outlet opening/closing member 520 floats and is separated from the chamber communicating unit 430 because of being pressurized from the first room 410 through the chamber communicating unit 430, to thereby open the chamber communicating unit 430. Herein, the flow of the fog which moves to the second room 420 from the first room 410 through the chamber communicating unit 430 helps the outlet opening/closing member 410 float.

The fog receiving unit 600 receives the fog exhaled from the outlet unit 421. The fog receiving unit 600 has the outlet pipe 610 connected to the outlet unit 421 so that the fog exhaled from the outlet unit 421 can be directed to the fog receiving unit 600.

A collecting process of the fog in the image forming apparatus 1 with this configuration according to an exemplary embodiment of the present general inventive concept will be described with reference to FIG. 1 through FIG. 3B.

If the spitting process begins, the spitting unit 200 moves to the lower part of the cartridge 100 to face the nozzle unit 110. The cartridge 100 ejects a predetermined amount of the ink stored in the inner part thereof. The ejected ink is collected by the spitting unit 200. During this process, the ink scattered from the spitting unit 200 generates large amount of fog.

The bellows unit 310 is expanded by operating the driving unit 330. By this, the pressure of the first room 410 decreases, and the pressure of the second room 420 increases relatively higher than the pressure of the first room 410. With this, the inlet opening/closing member 510 opens the inlet unit 411, the outlet opening/closing member 520 closes the chamber communicating unit 430. The fog is inhaled along the inlet pipe 210 and is directed to the first room 410. Part of the fog directed to the first room 410 may be directed to the chamber connecting pipe 320. Also, since the chamber communicating unit 430 is closed, the fog of fog receiving unit 600 can be prevented from being directed to the first room 410. (Refer to FIG. 3A)

The bellows unit 310 is compressed by the driving unit 330. The pressure of the first room 410 increases and the pressure of the second room 420 decreases relatively lower than the pressure of the first room 410. The inlet opening/closing unit 510 pressurized by the pressure of the first room 410 closes the inlet unit 411 and the outlet opening/closing member 520 opens the chamber communicating unit 430. The fog directed to the first room 410 when the bellows unit 310 is expanded, is prevented from being exhaled to the inlet pipe 210 because of closing the inlet unit 411. According to the compression of the bellows unit 310, the part of the fog directed to the chamber connecting pipe 320 is exhaled to the first room 410, is directed to the second room 420 with the fog of the first room 410, is exhaled through the outlet unit 421, and is collected to the fog receiving unit 600 along the outlet pipe 610. (Refer to FIG. 3B)

Hence, by repetitively expanding and compressing the bellows unit 310, the fog generated in a peripheral region of the spitting unit 200 is repetitively collected to the fog receiving unit 600 through the chamber 400.

Another exemplary embodiment of the present general inventive concept is different from the first embodiment with respect to an air pressure generating unit and a chamber, which is described below omitting description of similar components to avoid repetitive descriptions.

As illustrated in FIG. 1 and FIG. 4 to FIG. 6, an image forming apparatus 1 according to another exemplary embodiment of the present general inventive concept may include an air pressure generating unit 300, a chamber 400, and a valve unit 500.

The air pressure generating unit 300 may include a cylinder 340, a piston 350 to reciprocate in the cylinder 340, and a driving unit 330 to reciprocate the piston 350.

The cylinder 340 can be hollow and airtight from the outside. The chamber connecting pipe 320 is provided on one side of the space whose air is expanded and compressed according to the reciprocating motion of the piston 350. According to the reciprocating motion of the piston 350, an inner air of the cylinder 340 is expanded and compressed, and a pressure of the chamber inner space 440 (to be described later) increases and decreases through the chamber connecting pipe 320.

One side of the piston 350 is connected to the driving unit 330 so that the piston 350 can be reciprocated by the driving of the driving unit 330 within the cylinder 340. The piston 350 expands and compresses the inner air of the cylinder 340 by the reciprocating motion thereof. For example, the inner air of the cylinder 340 is expanded when the piston 350 moves backward, and the inner air of the cylinder 340 is compressed when the piston 350 moves forward.

The chamber 400 may include a chamber inner space 440, an inlet valve receiving unit 450 to receive an inlet valve unit 530 (to be described later), an outlet valve receiving unit 460 to receive an outlet valve unit 540 (to be described later), and a valve receiving slit 470 to be provided between the inlet valve receiving unit 450 and the outlet valve receiving unit 460 to mount the valve unit 500.

The chamber inner space 440 can be formed by the space of an inner part of the chamber 400. The chamber connecting pipe 320 connected to the cylinder 340 passes through one side of the chamber inner space 440 so that the inner pressure of the chamber inner space 440 is changed by the reciprocating motion of the piston 350. For example, the pressure of the chamber inner space 440 decreases if the inner air of the cylinder 340 is expanded. The pressure of the chamber inner space 440 increases if the inner air of the cylinder 340 is compressed.

The inlet valve receiving unit 450 is spaced apart from the chamber inner space 440 and is formed in the chamber 400. A fog inlet 451 connected to the inlet pipe 210 is formed on one side of the inlet valve receiving unit 450. Also, a chamber inlet 453 which communicates with the chamber inner space 440 is formed on a flowing channel to direct the fog from the fog inlet 451. Herein, the chamber inlet 453 is provided in a place where the inhaled fog can freely move to chamber inner space 440 when the fog inlet 451 is opened by the inlet valve unit 530 (to be described later).

The outlet valve receiving unit 460 can be formed in the chamber 400 while being spaced apart from both the chamber inner space 440 and the inlet valve receiving unit 450. A chamber outlet 461 which communicates with the chamber inner space 440 can be formed on one side of the outlet valve receiving unit 460. Also, a fog outlet 463 connected to the outlet pipe 610 can be formed on the flowing channel to exhale the fog from the chamber outlet 461. Herein, the fog outlet 463 can be provided in a place where the fog can be exhaled to the outlet pipe 610 when the outlet valve unit 540 (to be described later) opens the chamber outlet 461.

The valve receiving slit 470 is provided between, and communicates with, the inlet valve receiving unit 450 and the outlet valve receiving unit 460, so that the valve unit 500 can be mounted in the chamber 400. The valve receiving slit 470 allows the inlet valve unit 530 (to be described later) and the outlet valve unit 540 to be mounted to the inlet valve receiving unit 450 and outlet valve receiving unit 460 respectively, at once, when the valve unit 500 formed as a single board is mounted to the chamber 400. By this, an ease of assembly of the valve unit 500 in the chamber 400 can be improved. Herein, a size of the valve receiving slit 470 is determined to maintain air-tightness between the inlet valve receiving unit 450 and the outlet valve receiving unit 460, and space them apart from each other when the valve unit 500 is installed.

The valve unit 500 can be formed as a single board which is accommodated in and mounted to the inlet valve receiving unit 450, the valve receiving slit 470, and the outlet valve receiving unit 460. The inlet valve unit 530 and the outlet valve unit 540 are formed on the board of the valve unit 500 with a predetermined distance therebetween.

The inlet valve unit 530 is coupled to the inlet valve receiving unit 450, and opens/closes the fog inlet 451. The inlet valve unit 530 may include an inlet valve fastened end 531 and an inlet valve free end 533 to move by a predetermined distance with respect to the inlet valve fastened end 531.

The inlet valve free end 533 moves within the inlet valve receiving unit 450 by the predetermined distance when the pressure of the chamber inner space 440 decreases, thereby opening the fog inlet 451. By this, the fog inhaled to the fog inlet 451 is directed to the chamber inner space 440 via the chamber inlet 453.

A diameter of the inlet valve free end 533 can be larger than the fog inlet 451. By this, when the pressure of the chamber inner space 440 increases, the inlet valve free end 533 pressurized by the pressure closes the fog inlet 451, so that the fog of the chamber inner space 440 can be prevented from being exhaled into the inlet pipe 210.

The outlet valve unit 540 is coupled to the outlet valve receiving unit 460, and opens/closes the chamber outlet 461. The outlet valve unit 540 includes an outlet valve fastened end 541 and an outlet valve free end 543 to move at the predetermined distance toward the outlet valve fastened end 541.

When the pressure of the chamber inner space 440 increases, the outlet valve free end 543 moves within the outlet valve receiving unit 460 at the predetermined distance and opens the chamber outlet 461. By this, the fog of the chamber inner space 440 is exhaled along the outlet pipe 610 through the fog outlet 463.

The diameter of the outlet valve free end 543 can be larger than the chamber outlet 461. By this, when the pressure of the chamber inner space 440 decreases, the outlet valve free end 543 closes the chamber outlet 461 so that the fog of the fog receiving unit 600 is prevented from being directed to the chamber inner space 440.

A process to collect fog according to the above exemplary embodiment of the present general inventive concept is described referring to FIG. 1 and FIGS. 4 to 6.

If the fog is generated in the spitting unit 200, the inner air of the cylinder 340 is alternately expanded and compressed by the reciprocating motion of the piston 350. According to this, the pressure of the chamber inner space 440 is changed.

The pressure of the chamber inner space 440 decreases if the piston moves backward. Thus, the inlet valve unit 530 opens the fog inlet 451, and the fog is inhaled along the inlet pipe 210 and is directed to the chamber inner space 440 through the fog inlet 451, the inlet valve receiving unit 450, and chamber inlet 453.

If the pressure of the chamber inner space 440 decreases, the pressure of the outlet valve receiving unit 460 increases higher than the pressure of the chamber inner space 440 so that the outlet valve unit 540 can close the chamber outlet 461 by the pressure of the outlet valve receiving unit 460. Accordingly, the fog of the fog receiving unit 600 is prevented from being directed to the chamber inner space 440 through the outlet pipe 610 (Refer to FIG. 5A).

If the piston 350 moves forward, the pressure of the chamber inner space 440 increases. The inlet valve unit 530 closes the fog inlet 451 by the pressure so that the fog of the chamber inner space 440 can be prevented from being exhaled into the inlet pipe 210. Also, the outlet valve unit 540 opens the chamber outlet 461, the fog of the chamber inner space 440 is exhaled to the fog receiving unit 600 through the chamber outlet 461, the outlet valve receiving unit 460, and the fog outlet 463 along the outlet pipe 610 (Refer to FIG. 5B).

The pressure of the chamber inner space 440 is changed by the reciprocating motion of the piston 350. Accordingly, the fog is repetitively inhaled and exhaled through the chamber 400.

As the above description, the present general inventive concept provides an image forming apparatus, which is capable of collecting the fog generated at the spitting process by various configurations of an air pressure generating unit 300, chamber 400, and a valve unit 500 without difficulty. In addition, as the above description, configurations of an image forming apparatus according to the present general inventive concept may vary by those skilled in the art.

As described above, the present general inventive concept provides an image forming apparatus which collects a fog generated in the image forming apparatus to prevent an inner part of the apparatus from being polluted, and to guarantee a quality of an image formed on a record material. Also, the simple configuration of the image forming apparatus increases an ease of assembly and productivity and improves a reliability of the product.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a cartridge which ejects an ink;

a chamber having an inlet unit which inhales a fog which is generated when the ink is ejected from the cartridge and an outlet unit which exhales the inhaled fog;

an air pressure generating unit connected to the chamber to generate an air pressure to inhale and exhale the fog from the chamber;

a valve unit which selectively opens and closes the inlet unit and the outlet unit by the air pressure generated in the air pressure generating unit, and a fog receiving unit connected to the outlet unit to receive the fog which is exhaled from the chamber.

2. The image forming apparatus according to claim 1, wherein the air pressure generating unit comprises:

a bellows unit which expands and compresses to change the inner pressure of the chamber; and a driving unit to expand and compress the bellows unit.

3. The image forming apparatus according to claim 2, wherein the chamber comprises:

a first room formed with the inlet unit on a first side thereof to communicate with the air pressure generating unit on a second side thereof;

a second room separated from the first room and formed with the outlet unit on one side thereof; and a chamber communicating unit to be formed so as to allow the first room to communicate with the second room.

4. The image forming apparatus according to claim 2, wherein the valve unit comprises:

an inlet valve unit provided in the inlet unit and opened if the fog is inhaled to the chamber; and an outlet valve unit provided in the outlet unit and opened if the fog is exhaled from the chamber.

5. The image forming apparatus according to claim 1, wherein the air pressure generating unit comprises:

a cylinder to communicate with the chamber;

a piston to reciprocate in the cylinder to expand and compress the inner air of the cylinder; and a driving unit to reciprocate the piston.

6. The image forming apparatus according to claim 5, wherein the valve unit comprises:

an inlet valve unit provided in the inlet unit and opened if the fog is inhaled to the chamber; and an outlet valve unit provided in the outlet unit and opened if the fog is exhaled from the chamber.

7. The image forming apparatus according to claim 1, wherein the chamber comprises:

a first room formed with the inlet unit on a first side thereof to communicate with the air pressure generating unit on a second side thereof;

a second room separated from the first room and formed with the outlet unit on one side thereof; and a chamber communicating unit to be formed so as to allow the first room to communicate with the second room.

8. The image forming apparatus according to claim 1, wherein the valve unit comprises:

an inlet valve unit provided in the inlet unit and opened if the fog is inhaled to the chamber; and an outlet valve unit provided in the outlet unit and opened if the fog is exhaled from the chamber.

9. The image forming apparatus according to claim 1, wherein the valve unit comprises:

an inlet valve unit provided in the inlet unit and opened if the fog is inhaled to the chamber; and an outlet valve unit provided in the outlet unit and opened if the fog is exhaled from the chamber.

10. An image forming apparatus, comprising:

a cartridge to eject ink;

a spitting unit to receive the ink ejected from the cartridge during a spitting process; and a fog removing unit to remove a fog generated during the spitting process, the fog removing unit comprising:

a chamber connected to the spitting unit to inhale the fog therefrom, a fog receiving unit to receive a fog exhaled from the chamber, and an air pressure generating unit to change an internal air pressure of the chamber to inhale the fog from the spitting unit and exhale the fog to the fog receiving unit.

11. The image forming apparatus of claim 10, wherein the chamber comprises:

an inlet unit to receive the fog from the spitting unit;

an outlet unit to direct the fog to the fog receiving unit; and a valve unit to selectively open and close the inlet unit and the outlet unit by the air pressure changes generated by the air pressure generating unit.

12. The image forming apparatus of claim 11, wherein the valve unit comprises a flexible plate to allow one-way flow of the fog through only one of the inlet and outlet units according to the internal air pressure of the chamber.

13. The image forming apparatus of claim 11, wherein the inlet unit comprises a gravity valve to allow the fog into the chamber when the internal pressure thereof is decreased by the air pressure generating unit, and prevents the fog from flowing back to the spitting unit when the internal pressure of the chamber is increased by the air pressure generating unit.

14. The image forming apparatus of claim 11, wherein the outlet unit comprises a gravity valve to allow the fog in the chamber to flow to the fog receiving unit when the internal pressure of the chamber is increased by the air pressure generating unit, and prevents the fog from flowing back from the fog receiving unit when the internal pressure of the chamber is decreased by the air pressure generating unit.

15. A fog absorption apparatus to absorb a fog created from an ink spitting unit, the apparatus comprising:

a fog chamber including a first one way valve to allow an inhale of the fog created from an ink spitting process of the ink spitting unit and a second one way valve to allow an exhale of the inhaled fog externally away from the ink spitting unit, wherein the first one way valve comprises an inlet pipe and a ball.

16. The fog absorption apparatus of claim 15, further comprising:

an air pressure generation unit to generate a negative air pressure in the fog chamber so that the fog chamber inhales the fog and to generate a positive air pressure so that the fog chamber exhales the inhaled fog.

17. The fog absorption apparatus of claim 15, wherein the fog chamber comprises a first chamber room and a second chamber room and a chamber communicating unit.

18. The fog absorption apparatus of claim 17, wherein the chamber communicating unit comprises a passage between the first and second chamber rooms and a ball disposed at the passage to block airflow in one direction.

* * * * *